United States Patent [19]

Tomioka et al.

[11] Patent Number: 4,500,384

[45] Date of Patent: Feb. 19, 1985

[54] PROCESS FOR PRODUCING A NON-WOVEN FABRIC OF HOT-MELT-ADHERED COMPOSITE FIBERS

[75] Inventors: Susumu Tomioka; Masahiko Taniguchi, both of Shigaken, Japan

[73] Assignee: Chisso Corporation, Osaka, Japan

[21] Appl. No.: 463,074

[22] Filed: Feb. 2, 1983

[30] Foreign Application Priority Data

Feb. 5, 1982 [JP] Japan ..... 57-17126

[51] Int. Cl.[3] ..... D02G 3/00; D04H 1/54; D04H 1/56; B32B 27/02

[52] U.S. Cl. ..... 156/290; 156/296; 156/309.6; 428/198; 428/296; 428/373

[58] Field of Search ..... 156/166, 167, 181, 290, 156/296, 309.6, 308.2, 62.4; 264/171; 428/296, 221, 332, 336, 373, 359, 288, 198, 370, 375

[56] References Cited

U.S. PATENT DOCUMENTS

| | | | |
|---|---|---|---|
| 3,589,956 | 6/1971 | Kranz et al. | 156/62.4 |
| 3,595,731 | 7/1971 | Davies et al. | 161/150 |
| 3,620,892 | 11/1971 | Wincklhofer | 428/296 |
| 3,645,819 | 2/1972 | Fujii | 156/166 |
| 4,088,726 | 5/1978 | Cumbers | 428/198 X |
| 4,189,338 | 2/1980 | Ejima et al. | 156/167 |
| 4,211,819 | 7/1980 | Kunimune | 428/373 |
| 4,234,655 | 11/1980 | Kunimune | 428/296 |
| 4,269,888 | 5/1981 | Ejima | 156/181 |

*Primary Examiner*—Michael Ball
*Assistant Examiner*—Ramon R. Hoch
*Attorney, Agent, or Firm*—Fred Philpitt

[57] ABSTRACT

A process for producing a non-woven fabric of hot-melt-adhered composite fibers having a high strength in a small weight thereof and soft feeling is provided, which process comprises forming a web of fiber aggregate consisting of sheath and core type composite fibers alone composed of a first (core) component of a fiber-formable polymer and a second (sheath) component of one kind or more of polymers having a m.p.(s) lower than that of the first by 30° C. or more and also having a specified average thickness, or mixed fibers of the composite fibers with other fibers containing the composite fibers in a specified amount; and heat-treating the web at a temperature lower than the m.p. of the first component and equal to or lower than that of the second, and affords to the second, a specified apparent viscosity as measured at a specified rate to thereby stabilize the form of the web by hot-melt-adhesion of the second.

5 Claims, No Drawings

PROCESS FOR PRODUCING A NON-WOVEN FABRIC OF HOT-MELT-ADHERED COMPOSITE FIBERS

BACKGROUND OF THE INVENTION

1. Field of the Invention

This invention relates to a process for producing a non-woven fabric. More particularly it relates to a process for producing a non-woven fabric of hot-melt-adhered composite fibers.

2. Description of the Prior Art

Non-woven fabrics obtained by using composite fibers consisting of composite components of fiber-formable polymers having different melting points have been known from Japanese patent publication Nos. Sho 42-21,318/1967, Sho 44-22,547/1969, Sho 52-12,830/1974, etc. In recent years, with more variety of application fields of non-woven fabrics, properties required for non-woven fabrics have been levelled up, and it has been basically required for the fabrics to retain a high strength in as small a weight of the fabrics as possible, and also to be provided with as soft feeling as possible. Thus, according to the above-mentioned known processes employing composite fibers composed merely of composite components having different melting points, it has been impossible to satisfy the above-mentioned requirements.

The present inventors have made strenuous studies on a process for producing a non-woven fabric which retains a high strength in as small a weight of the fabric as possible and also is provided with as soft a feeling as possible, and have attained the present invention.

SUMMARY OF THE INVENTION

The present invention resides in:

a process for producing a non-woven fabric of hot-melt-adhered composite fibers which mainly comprises forming a web of fiber aggregate consisting of sheath and core type composite fibers alone (hereinafter abbreviated merely to composite fibers) composed of as the core component of said composite fibers, a first component of a fiber-formable polymer, and as the sheath component, a second component of one kind or more of polymers having a melting point or points lower than that of said first component by 30° C. or more and also having an average thickness of 1.0 to 4.0 microns, or mixed fibers of said composite fibers with other fibers containing said composite fibers in an amount of at least 20% by weight based on the total amount of said mixed fibers; and subjecting said web of fiber aggregate to a heat treatment at a temperature which is lower than the melting point of said first component and equal to or higher than the melting point of said second component, and affords to said second component, an apparent viscosity of $1\times10^3$ to $5\times10^4$ poises as measured at a shear rate of 10 to 100 $sec^{-1}$, to thereby stabilize the form of said web of fiber aggregate by way of the hot-melt adhesion of said second component.

DETAILED DESCRIPTON OF THE INVENTION

The present invention will be described in more detail.

The reason that the difference between the respective melting points of the two components of the composite fibers is limited to 30° C. or more in the present invention is that when heat treatment is carried out at a temperature at which an apparent viscosity of the second component of $1\times10^3$ to $5\times10^4$ poises as measured at a shear rate of 10 to 100 $sec^{-1}$ is afforded in the production of a non-woven fabric as described above, it is impossible to attain such a viscosity unless the temperature is at least 10° C. higher than the melting point of the second component, and if the difference between the temperature at the time of the heat treatment and the melting point of the first component is 20° C. or lower, such an undesirable result is brought about that deformation due to heat shrinkage, etc. occurs in the composite fibers to thereby inhibit the dimensional stability of the resulting non-woven fabric.

The reason that when the second component is arranged at the sheath part of the composite fibers, the average thickness of the component is limited within a range of 1.0 to 4.0 microns, is as follows:

In the case where the average thickness of the second component is less than 1.0 micron, even if the composite fibers are subjected to hot-melt adhesion under heat treatment conditions where an adequate melt viscosity is exhibited, such drawbacks occur that the area of the part where the hot-melt adhesion is effected is so small that the resulting non-woven fabric has a low strength, and further, when the web of fiber aggregate is formed during the step in advance of the heat treatment, the second component is liable to be peeled off due to mechanical shock, friction, etc. which the composite fibers incur, and generation of such peeling-off reduces the strength of the non-woven fabric to an extremely large extent. On the other hand, in the case where the average thickness of the second component exceeds 4.0 microns, such drawbacks occur that during the temperature-raising step for the heat treatment, a shrinking force acts on the second component in the vicinity of the softening point to the melting point of the second component to form projections and depressions on the surface of the composite fibers, and even when the temperature is thereafter raised up to an adequate one and the apparent viscosity of the second component is reduced, the projections and depressions are insufficiently levelled up so that the second component is existent in the form of drop or sphere on the surface of the first component, resulting in a reduced adhesive force, a non-woven fabric having a hard feeling, etc.

The average thickness of the second component can be readily calculated from the composite ratio of the first component to the second component at the time of spinning by means of a known sheath and core type composite spinning machine, and the fineness (denier) of the resulting composite fibers.

Next, the reason that the heat treatment temperature for the production of the non-woven fabric is defined as a temperature which is lower than the melting point of the first component and equal to or higher than the melting point of the second component, and affords to the second component, an apparent viscosity of $1\times10^3$ to $5\times10^4$ poises as measured at a shear rate of 10 to 100 $sec^{-1}$, is as follows:

In the case where the apparent viscosity is as high as in excess of $5\times10^4$ (that is, the temperature is low), the area of heat-melt adhesion of the second component at the contact parts between the respective composite fibers is so small that the resulting non-woven fabric has a reduced strength. If the area of the hot-melt-adhesion part is increased by mechanically compressing the web of fiber aggregate at the above-mentioned heat treatment temperature, the feeling of the resulting non-woven fabric is hard and hence such a case is undesirable. On the other hand, in the case where the apparent viscosity is as low as lower than $1\times10^3$ (that is, the temperature is high), hot-melt-adhesion of the second component at the contact parts between the respective composite fibers is too easy and hence the area of hot-melt-adhesion is so large that the resulting non-woven fabric is paper-like and deficient in softness and has a hard feeling; hence such a case is also undesirable. Further, at such a heat treatment temperature, even if the average thickness of the second component is with the range of 1 to 4 microns, the second component is liable to be existent in the form of drop or sphere on the first component; hence such a case is also undesirable.

The composite fibers employed in the present invention must be those having composite components arranged so that the second component can have a temperature range affording an apparent viscosity of $1\times10^3$ to $5\times10^4$ poises as measured at a shear rate of 10 to 100 $sec^{-1}$ and the first component can have a melting point higher than the above-mentioned temperature range. The apparent viscosity of the second component referred to herein means the apparent viscosity of the second component after passing through the spinning process, and such a viscosity can be determined by measuring a sample obtained by spinning the second component alone under the same conditions as those on the second component side at the time of composite spinning, according to a known method (e.g. JIS K7210: a method employing Kohka type flow tester).

The web of fiber aggregate from which a non-woven fabric is produced by heat treatment in the present invention includes not only a web of fiber aggregate consisting singly of composite fibers having the above-mentioned specific features, but also a web of fiber aggregate consisting of a mixture of the composite fibers with other fibers containing the composite fibers in an amount of at least 20% by weight in the mixture, and this web of fiber aggregate is also preferably employed. As such other fibers, any of fibers which cause neither melting nor large heat shrinkage at the time of heat treatment for producing the non-woven fabric may be used, and for example, one kind or more of fibers suitably choiced from natural fibers such as cotton, wool, etc., semisynthetic fibers such as viscose rayon, cellulose acetate fibers, etc., synthetic fibers such as polyolefin fibers, polyamide fibers, polyester fibers, acrylic fibers, etc. and inorganic fibers such as glass fibers, asbestos, etc. may be used. Their amount used is in a proportion of 80% by weight or less based on the total weight of these fibers and the composite fibers. If the proportion of the composite fibers in the web of fiber aggregate is less than 20% by weight, the strength of the resulting non-woven fabric is reduced; hence such proportions are undesirable.

As the process for forming the web of fiber aggregate from the composite fibers alone or a mixture thereof with other fibers, any known processes generally employed for producing non-woven fabrics may be employed such as carding process, air-laying process, dry pulping process, wet paper-making process, etc.

For the heat treatment process for converting the web of fiber aggregate into a non-woven fabric by hot-melt-adhesion of the lower melting component of the composite fibers, any of dryers such as hot-air dryer, suction drum dryer, Yankee dryer, etc. and heating rolls such as flat calender rolls, embossing rolls, etc. may be employed.

The present invention will be further described by way of Examples. In addition, methods for measuring values of physical properties shown in the Examples or definitions thereof are collectively shown below.

Strength of non-woven fabric:

According to JIS L1096, a sample piece of 5 cm wide was measured at an initial distance between grips, of 10 cm and at a rate of stretching per minute of 100%.

Feeling of non-woven fabric:

Evaluation was made by functional tests by 5 panellers.

o: case where all the paneller judged the fabric to be soft.

Δ: case where three or more panellers judged it to be soft.

x: case where three or more panellers judged it to be deficient in soft feeling.

Apparent viscosity:

According to flow test method of JIS K7210 (reference test), Q value was measured by means of Kohka type flow tester and the viscosity was calculated from the Q value according to the following conversion equations:

$$\text{Shear rate: } D'm = 4Q/\pi r^3 \quad (1)$$

$$\text{Shear stress: } \tau m = Pr/2l \quad (2)$$

$$\text{Apparent viscosity: } \eta = 4\tau m/D'm\cdot(3 + d\log D'm/d\log \tau m) \quad (3)$$

wherein Q represents an efflux amount ($cm^3$/sec), r represents radius of nozzle (=0.05 cm) and l represents a length of nozzle (=1.00 cm), and as the pressure P to be measured, the respective values of 10, 15, 25, 50 and 100 $Kg/cm^2$ were employed.

EXAMPLE 1

Melt-spinning was carried out at 265° C., using a polypropylene having a melt flow rate of 15 (m.p. 165° C.) as the first component (core component) and an ethylene-vinyl acetate copolymer having a melt index of 20 (vinyl acetate content 15%, m.p. 96° C.) as the second component (sheath component), and also employing a spinneret of 50 holes each having a hole diameter of 0.5 mm, to obtain unstretched filaments having various composite ratios shown in Table 1. Further, a gear pump on the first component side was stopped and the second component alone was taken up to prepare a sample for measuring the apparent viscosity. These unstretched filaments were all stretched to 4.0 times the original lengths at 50° C., crimped in a stuffer box and cut to a fiber length of 51 mm to obtain composite fibers of 3 deniers having average thicknesses of the sheath part shown in Table 1.

From these composite fibers were prepared webs of about 100 $g/m^2$ according to air-laying process, followed by heat treatment at definite temperatures each for 30 seconds by means of an air-suction type dryer to obtain non-woven fabrics. Evaluations of the strength and feeling of the non-woven fabrics thus obtained are shown in Table 1.

TABLE 1

| Test No. | Composite ratio (first/second) | Average thickness of sheath part, μ | Strength Kg | Feeling | Strength Kg | Feeling | Strength Kg | Feeling | Strength Kg | Feeling |
|---|---|---|---|---|---|---|---|---|---|---|
| Temperature at which apparent viscosity is measured (heat treatment temperature), °C. | | | 100 | | 110 | | 140 | | 145 | |
| Apparent viscosity, poise (10 $sec^{-1}$; 100 $sec^{-1}$) | | | $7.2 \times 10^4$; $5.5 \times 10^4$ | | $9.0 \times 10^3$; $8.5 \times 10^3$ | | $3.5 \times 10^3$; $3.0 \times 10^3$ | | $9.0 \times 10^2$; $8.2 \times 10^2$ | |
| 1-1 | 90/10 | 0.6 | 6.3 | Δ | 8.9 | Δ | 9.2 | Δ | 7.0 | x |
| 1-2 | 80/20 | 1.2 | 11.5 | Δ | 18.8 | o | 20.0 | o | 15.5 | Δ |
| 1-3 | 60/40 | 2.5 | 12.3 | o | 19.6 | o | 21.1 | o | 16.0 | Δ |
| 1-4 | 40/60 | 4.0 | 12.7 | Δ | 21.5 | o | 20.8 | o | 16.3 | x |
| 1-5 | 30/70 | 4.9 | 10.8 | x | 15.2 | x | 15.3 | x | 13.8 | x |

EXAMPLE 2

Melt-spinning was carried out at 295° C. in the same manner as in Example 1, using a polyethylene terephthalate having an intrinsic viscosity of 0.65 (m.p. 258° C.) as the first component and a high density polyethylene having a melt index of 23 (m.p. 130° C.) as the second component. The resulting unstretched filaments were stretched to 2.5 times the original length at 110° C., crimped in a stuffer box and cut to a fiber length of 64 mm to obtain composite fibers of 3 deniers having an average thickness of the sheath part shown in Table 2.

From these composite fibers were prepared webs of about 20 g/$m^2$ according to carding process, followed by heat treatment by means of calender rolls consisting of a combination of a metal flat roll kept at a definite temperature with a cotton roll, under a pressure of 5 Kg/$cm^2$ to obtain non-woven fabrics. Evaluations of the strength and feeling of these non-woven fabrics are shown in Table 2 in contrast to the production conditions.

TABLE 2

| Test No. | Composite ratio (first/second) | Average thickness of sheath part, μ | Strength Kg | Feeling | Strength Kg | Feeling | Strength Kg | Feeling | Strength Kg | Feeling |
|---|---|---|---|---|---|---|---|---|---|---|
| Temperature at which apparent viscosity is measured (heat treatment temperature), °C. | | | 132 | | 145 | | 160 | | 180 | |
| Apparent viscosity, poise (10 $sec^{-1}$; 100 $sec^{-1}$) | | | $6.5 \times 10^4$; $5.0 \times 10^4$ | | $7.0 \times 10^3$; $6.5 \times 10^3$ | | $3.0 \times 10^3$; $2.0 \times 10^3$ | | $8.0 \times 10^2$; $7.5 \times 10^2$ | |
| 2-1 | 90/10 | 0.5 | 2.2 | x | 4.1 | Δ | 4.0 | Δ | 3.3 | Δ |
| 2-2 | 80/20 | 1.0 | 3.8 | Δ | 6.2 | o | 6.5 | o | 4.3 | Δ |
| 2-3 | 60/40 | 2.1 | 3.2 | x | 7.7 | o | 8.2 | o | 4.9 | x |
| 2-4 | 40/60 | 3.8 | 4.4 | x | 8.1 | o | 7.8 | o | 4.0 | x |
| 2-5 | 30/70 | 4.5 | 3.8 | x | 5.9 | x | 6.0 | x | 4.5 | x |

From the experiment results of Examples 1 and 2, it is seen that when a web of fiber aggregate consisting of composite fibers the second component (sheat part of which has an average thickness of 1 to 4 microns is subjected to heat treatment at a temperature which is lower than the melting point of the first component, equal to or higher than the melting point of the second component and affords an apparent viscosity of the second component of $1 \times 10^3$ to $5 \times 10^4$ as measured at a shear rate of 10 to 100 $sec^{-1}$, it is possible to obtain a non-woven fabric having a high strength and also good feeling.

EXAMPLE 3

From mixtures of composite fibers used in Example 1 (Test Nos. 1-3) (20% by weight) with polyester fibers (6d × 64 mm, m.p. 258° C.) (80% by weight) were prepared webs of about 200 g/$m^2$ according to carding process, followed by heat treatment at 135° C. for 30 seconds by means of an air suction type dryer to obtain non-woven fabrics. These non-woven fabrics had a sufficient strength (7.4 Kg) for kilt products and few fluffs on the surface and a soft feeling.

What is claimed is:

1. A process for producing a soft and light-weight non-woven faric of hot melt adhered fibers, which mainly comprises:

(A) forming a web of fiber aggregate consisting of:

(1) sheath-and-core composite fibers alone the core component of said composite fibers being a fiber-formable polymer, the sheath component having an average thickness of 1-4 microns comprising at least one polymer having a melting point at least 30° C. lower than that of said core component, or (2) mixed fibers of said sheath-and-core composite fibers with other fibers containing said composite fibers in an amount of at least 20% by weight based on the total amount of said mixed fibers, (B) imparting crimps to the sheath-and-core type composite fibers, and (C) subjecting said web of fiber aggregate to a heat treatment at a temperature which is lower than the melting point of said core component and equal to or higher than the melting point of said sheath component, and which affords to said sheath component an apparent viscosity of $1\times10^3$ to $5\times10^4$ poises as measured at a shear rate of 10 to 100 $sec^{-1}$, to thereby stabilize the form of said web of fiber aggregate by way of the hot-melt adhesion of said sheath component.

2. A process according to claim 1 wherein the core component is polypropylene and the sheath component is ethyl-vinyl acetate.

3. A process according to claim 2 wherein the polypropylene has a melt flow rate of 15 and the ethyl-vinyl-acetate has a melt index of 20.

4. A process according to claim 1 wherein the core component is polyethylene terephthalate and the sheath component is a high density polyethylene.

5. A process according to claim 4 wherein said polyethylene terephthalate has an intrinsic viscosity of 0.65 and the polyethylene has a melt index of 23.

* * * * *